US010844666B2

(12) United States Patent
Looijen

(10) Patent No.: US 10,844,666 B2
(45) **Date of Patent: *Nov. 24, 2020**

(54) GEOTECHNICAL APPARATUS COMPRISING AT LEAST ONE ROD PROVIDED WITH A PROBE

(71) Applicant: Fugro Engineers B.V., Nootdorp (NL)

(72) Inventor: Peter Nicolaas Looijen, The Hague (NL)

(73) Assignee: FUGRO ENGINEERS B.V., Nootdorp (NL)

( * ) Notice: Subject to any disclaimer, the term of this patent is extended or adjusted under 35 U.S.C. 154(b) by 57 days.

This patent is subject to a terminal disclaimer.

(21) Appl. No.: 15/360,520

(22) Filed: Nov. 23, 2016

(65) Prior Publication Data

US 2017/0145750 A1 May 25, 2017

(30) Foreign Application Priority Data

Nov. 25, 2015 (NL) ..... 2015850

(51) Int. Cl.
*E21B 7/26* (2006.01)
*E02D 1/02* (2006.01)
*E21B 49/00* (2006.01)

(52) U.S. Cl.
CPC ..... *E21B 7/26* (2013.01); *E02D 1/02* (2013.01); *E02D 1/022* (2013.01); *E21B 49/00* (2013.01)

(58) Field of Classification Search
CPC E02D 1/02; E02D 1/022; E21B 17/00; B65H 75/4405
See application file for complete search history.

(56) References Cited

U.S. PATENT DOCUMENTS

| | | | | |
|---|---|---|---|---|
| 3,379,052 | A | 4/1968 | Howard et al. | |
| 4,499,954 | A | 2/1985 | Diggle | |
| 5,865,392 | A * | 2/1999 | Blount | B65H 75/4402 166/77.2 |
| 6,412,560 | B1 | 7/2002 | Bernat | |
| 6,527,055 | B1 | 3/2003 | Gipson | |
| 10,527,532 | B2 | 1/2020 | Looijen | |
| 2002/0195255 | A1 | 12/2002 | Reilly | |
| 2003/0010505 | A1 | 1/2003 | Gipson | |
| 2003/0075361 | A1 * | 4/2003 | Terry | G01V 3/30 175/61 |
| 2005/0133228 | A1 | 7/2005 | Shampine et al. | |

(Continued)

FOREIGN PATENT DOCUMENTS

| | | |
|---|---|---|
| CA | 890288 | 1/1972 |
| EP | 0803638 | 10/1997 |

(Continued)

*Primary Examiner* — David J Bagnell
*Assistant Examiner* — Dany E Akakpo
(74) *Attorney, Agent, or Firm* — Peacock Law P.C.; Janeen Vilven

(57) ABSTRACT

Geotechnical apparatus comprising at least one rod provided with a probe, which rod has a longitudinal bore extending along its body which is in fluid communication with one or more lubricating openings behind the probe for introducing lubricant along the rod's superficial area, wherein the apparatus further comprises a drive unit for the at least one rod for pushing said rod into the ground or pulling it from the ground.

5 Claims, 1 Drawing Sheet

(56) References Cited

U.S. PATENT DOCUMENTS

| | | | | |
|---|---|---|---|---|
| 2005/0269106 | A1* | 12/2005 | Wilson | E21B 23/14<br>166/381 |
| 2011/0154908 | A1 | 6/2011 | McKee et al. | |
| 2011/0289994 | A1 | 12/2011 | Smith et al. | |

FOREIGN PATENT DOCUMENTS

| | | |
|---|---|---|
| EP | 3173531 | 5/2017 |
| WO | 2005061842 | 7/2005 |

* cited by examiner

GEOTECHNICAL APPARATUS COMPRISING AT LEAST ONE ROD PROVIDED WITH A PROBE

CROSS-REFERENCE TO RELATED APPLICATIONS

This application claims priority to and the benefit of the filing of Netherlands Patent Application No. 2015850, filed on Nov. 25, 2015, and the specification and claims thereof are incorporated herein by reference.

STATEMENT REGARDING FEDERALLY SPONSORED RESEARCH OR DEVELOPMENT

Not Applicable.

THE NAMES OF PARTIES TO A JOINT RESEARCH AGREEMENT

Not Applicable.

INCORPORATION BY REFERENCE OF MATERIAL SUBMITTED ON A COMPACT DISC

Not Applicable.

STATEMENT REGARDING PRIOR DISCLOSURES BY THE INVENTOR OR A JOINT INVENTOR

Not Applicable.

COPYRIGHTED MATERIAL

Not Applicable.

BACKGROUND OF THE INVENTION

Field of the Invention (Technical Field)

The present invention relates to a geotechnical apparatus comprising at least one rod provided with a probe, which rod has a longitudinal bore extending along its body which is in fluid communication with one or more lubricating openings behind the probe for introducing lubricant along the rod's superficial area, wherein the apparatus further comprises a drive unit for the at least one rod for pushing said rod into the ground or pulling it from the ground.

Description of Related Art Including Information Disclosed Under 37 C.F.R. §§ 1.97 and 1.98

Such a geotechnical apparatus is known from U.S. Pat. No. 4,499,954. In this known apparatus a string of hollow rods is connected to a cone penetrometer that is pushed into a probe hole as used in geotechnical "in situ" testing. The rods have aligned bores communicating with each other and being of sufficient size to pass drilling fluid therethrough, which fluid is distributed through a plurality of lubricating openings behind the probe, which in this document U.S. Pat. No. 4,499,954 are preferably disposed upon a theoretical helix about the body of the rods. The drilling or lubricating fluid stabilizes the sidewall of the probe hole and lubricates the string of drill rods within the probe hole.

A problem of this known geotechnical apparatus is the necessity to build a string of hollow rods from a series of single rods in order to be able to provide the penetrometer up to a depth of 50 to 60 m in the ground. This operation requires a lot of manpower and consumes a lot of time during the process of pushing the string of rods into the ground, or during the process of retrieving the rods from the ground. There is also the risk that switching on and off of the lubricant to enable that from time to time a new rod is mounted to the string of rods, will spoil and damage the stratification of the soil in the ground.

BRIEF SUMMARY OF THE INVENTION

It is an object of the invention to improve this method of operation and to gain advantages in terms of savings in manpower and particularly time during entering or retrieving the rod with the penetrometer into or from the ground.

It is another object of the invention to provide such an apparatus which is equipped to be easily used both offshore as well as onshore.

Another object of the invention is to design the apparatus such that introducing the probe into the ground can be done while preventing damage to the soil formation as much as possible.

Further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE SEVERAL VIEWS OF THE DRAWINGS

The accompanying drawings, which are incorporated into and form a part of the specification, illustrate one or more embodiments of the present invention and, together with the description, serve to explain the principles of the invention. The drawings are only for the purpose of illustrating one or more embodiments of the invention and are not to be construed as limiting the invention. In the drawings.

DETAILED DESCRIPTION OF THE INVENTION

Figures 1, 2:
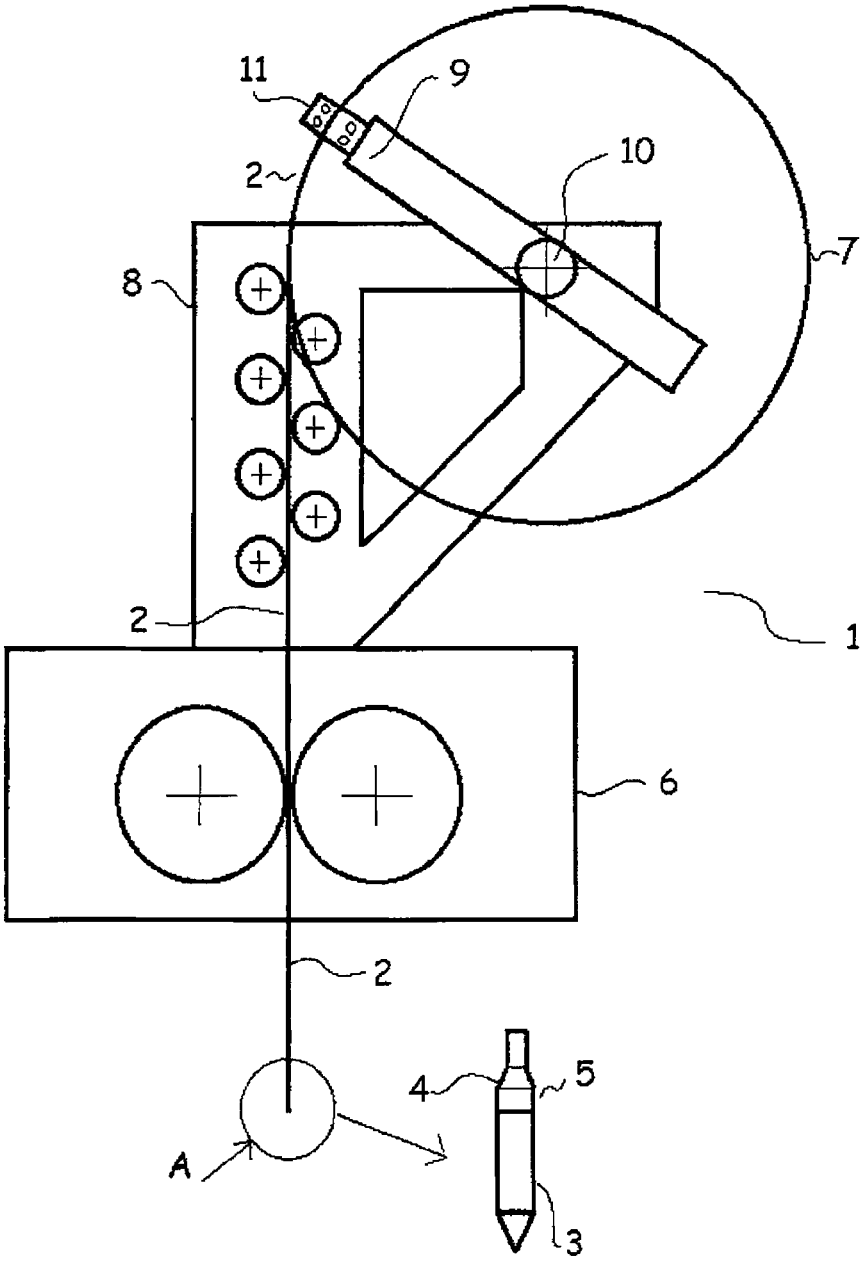
FIG. 1 schematically shows an apparatus according to the invention.
FIG. 2 schematically shows detail A of FIG. 1 representing the current penetrometer 3 at the lower extremity of the single piece rod of the apparatus of the invention.

Accordingly the invention proposes a method to push a rod provided with a probe, such as a penetrometer, into the ground or pulling it from the ground, wherein the rod has a longitudinal bore extending along its body which is in fluid communication with one or more lubrication openings behind the probe, comprising introduction of lubricant through said lubrication openings so as to provide said lubricant along the rod's superficial area, and simultaneously pushing said rod into the ground or pulling it from the ground, wherein a single piece rod is uncoiled from a storage or coiled onto or into said storage, in which storage the single piece rod is storable in coiled condition and from which the single piece rod is retrievable in said coiled condition, and providing a bender/straightener between the storage and the ground to convert the single piece rod between a straightly aligned condition and said coiled condition, and rotating said storage is executed to cause that the single piece rod coils or uncoils depending on the rotational direction of said storage.

The invention is correspondingly embodied in an apparatus wherein the at least one rod is a single piece rod and the apparatus comprises a storage for said single piece rod in which the single piece rod is storable in coiled condition and from which the single piece rod is retrievable in said coiled condition, wherein a bender/straightener is provided between the storage and the drive unit to convert the single piece rod between a straightly aligned condition and said coiled condition, wherein rotation of the storage causes the single piece rod to coil or uncoil depending on the direction of rotation of said storage.

Surprisingly it has been proven possible to efficiently and swiftly push such a single piece rod into the ground while it is uncoiled and straightened, and to retrieve it from the ground while it is being recoiled again for storage. Pushing and pulling the single piece rod with the apparatus of the invention can be easily applied both onshore and offshore.

Preferably the storage is embodied with at least one of a guide arm, an axle and/or a drum, and wherein rotation of the guide arm, the axle and/or said drum causes the single piece rod to coil or uncoil depending on the direction of rotation of said guide arm, axle or drum.

In one embodiment which is equipped with a guide arm, it is preferable that the guide arm is rotatable around an axis of rotation and is provided with a clamp distant from the axis of rotation which fixes the single piece rod to the guide arm. It suffices then using for the coiling/uncoiling merely a single rotatable guide arm which clamps the single piece rod.

Preferably the lubrication openings are provided immediately behind the probe. The lubrication fluid then fills the annulus in the borehole surrounding the rod behind the probe most effectively without spoiling the soil formation. The lubricant reduces friction between the rod and the soil and stabilizes the borehole.

The invention also provides the advantage that the lubrication fluid can be provided to said annulus surrounding the single piece rod with a constant lubrication fluid flow rate, which is beneficial for maintaining the soil stratification and prevent any damage to it.

It is remarked that uncoiling of a single piece rod is as such known from U.S. Pat. No. 266,206, but in this apparatus it is not possible to retrieve the single piece rod from the ground. Moreover it is unclear for which purpose the rod according to U.S. Pat. No. 266,206 is used. The device of U.S. Pat. No. 266,206 does not include and cannot be employed for a rod as in the invention considering that the rod of this publication cannot be retrieved, whereas the apparatus of the invention is provided with a probe for temporary placement in the ground to collect data on the stratification of the soil, which probe is thereafter retrieved.

The invention will hereinafter be further elucidated with reference to the drawings of an exemplary embodiment of an apparatus according to the invention that is not limiting as to the appended claims.

In FIG. 1 the geotechnical apparatus is schematically shown and depicted with reference 1. The apparatus 1 comprises a single piece rod 2 provided at its lower extremity with a probe 3 such as a penetrometer as more clearly shown in FIG. 2 providing a clear view to detail A of FIG. 1.

The rod 2 has a longitudinal bore in a conventional manner (and therefore not shown in the drawing) extending along its body which is in fluid communication with one or more lubricating openings 4,5 behind the probe 3 for introducing lubricant along the rod's superficial area. The lubricant reduces friction between the rod 2 and the soil, and promotes that the borehole is stabilized. With the single piece rod 2 of the invention the lubricant can be provided through the one or more lubrication openings 4,5 at a constant flow rate.

FIG. 1 further shows that the apparatus 1 comprises a drive unit 6 for the single piece rod 2 for pushing said rod into the ground or pulling it from the ground. Further it is shown that the apparatus 1 comprises a storage 7 for said single piece rod 2 wherein the rod 2 is storable in coiled condition and from which the single piece rod 2 is retrievable in said coiled condition. To support this storage and retrieval of the single piece rod 2 a bender/straightener 8 is provided between the storage 7 and the drive unit 6 to convert the single piece rod 2 between a straightly aligned condition and said coiled condition.

For coiling and uncoiling of the single piece rod 2, it is possible to apply only an axle, or for instance a drum. This is not shown in the drawing of the figures but is clear to the skilled person and requires therefore no further elucidation. Instead of a mere axle or drum FIG. 1 shows an embodiment wherein the storage 7 is embodied with a guide arm 9 which is rotatable around an axis 10 of rotation, and which arm 9 has a clamp 11 distant from the axis 10 of rotation which fixes the single piece rod 2 to the guide arm 9. This arranges that rotation of the guide arm 9 causes the single piece rod 2 to coil or uncoil depending on the direction of rotation of the guide arm 9.

Although the invention has been discussed in the foregoing with reference to an exemplary embodiment of the apparatus of the invention, the invention is not restricted to this particular embodiment which can be varied in many ways without departing from the invention. The discussed exemplary embodiment shall therefore not be used to construe the appended claims strictly in accordance therewith. On the contrary the embodiment is merely intended to explain the wording of the appended claims without intent to limit the claims to this exemplary embodiment. The scope of protection of the invention shall therefore be construed in accordance with the appended claims only, wherein a possible ambiguity in the wording of the claims shall be resolved using this exemplary embodiment.

What is claimed is:

1. A geotechnical apparatus comprising at least one rod provided with a probe, which rod has a longitudinal bore extending along its body which is in fluid communication with one or more lubrication openings behind the probe for introducing lubricant along the rod's superficial area, wherein the apparatus further comprises a drive unit for the at least one rod for pushing said rod into the ground or pulling it from the ground, wherein the at least one rod is a single piece rod and the apparatus comprises a storage for said single piece rod in which the single piece rod is storable in coiled condition and from which the single piece rod is retrievable in said coiled condition, wherein a bender/straightener is provided between the storage and the drive unit to convert the single piece rod between a straightly aligned condition and said coiled condition and vice versa, wherein the storage is rotatable and wherein the probe is a cone penetrometer, wherein the storage includes a rotatable guide arm which is rotatable around an axis of rotation and has a clamp distant from the axis of rotation which clamps the single piece rod to the guide arm, wherein rotation of the guide arm causes the single piece rod to coil or uncoil depending on the direction of rotation of said guide arm around the axis of rotation.

2. The geotechnical apparatus according to claim 1, wherein the lubrication openings are provided in the rod immediately behind the probe.

3. The geotechnical apparatus according to claim 1, wherein the apparatus is arranged to provide the lubricant through the one or more lubrication openings at a constant flow rate.

4. A method to push a rod provided with a probe into the ground or pulling it from the ground, wherein the rod is a single piece rod and has a longitudinal bore extending along its body which is in fluid communication with one or more lubrication openings behind the probe, comprising introduction of lubricant through said lubrication openings so as to provide said lubricant along the rod's superficial area, and simultaneously pushing said rod into the ground or pulling it from the ground, and further comprising uncoiling the single piece rod from a storage or coiling said single piece rod to the storage, in which storage the single piece rod is storable in coiled condition and from which the single piece rod is retrievable in said coiled condition, and providing a bender/straightener between the storage and the ground to convert the single piece rod between a straightly aligned condition and said coiled condition, and wherein the probe is a cone penetrometer, wherein the storage is provided with a rotatable guide arm which is rotatable around an axis of rotation and has a clamp distant from the axis of rotation which clamps the single piece rod to the guide arm, and rotating said storage whereby rotation of the guide arm causes the single piece rod to coil or uncoil depending on the direction of rotation of said guide arm around the axis of rotation.

5. The method according to claim 4, wherein introduction of lubricant comprises providing the lubricant through the one or more lubrication openings at a constant flow rate.

* * * * *